United States Patent [19]

Bon

[11] Patent Number: 4,951,644

[45] Date of Patent: Aug. 28, 1990

[54] PNEUMATIC LAUNCHER

[75] Inventor: David R. Bon, Panama City, Fla.

[73] Assignee: The United State of America as represented by the Secretary of the Navy, Washington, D.C.

[21] Appl. No.: 633,361

[22] Filed: Apr. 30, 1984

[51] Int. Cl.[5] ..... F41B 11/06

[52] U.S. Cl. ..... 124/75; 124/69

[58] Field of Search ..... 124/75, 73, 56, 69, 124/71; 89/1.3, 1.818, 1.8

[56] References Cited

U.S. PATENT DOCUMENTS

| | | | |
|---|---|---|---|
| 1,324,772 | 12/1919 | Goodyear | 124/75 |
| 1,335,448 | 3/1920 | Menon | 124/69 |
| 2,525,082 | 10/1950 | Sherman | 124/75 |
| 2,581,758 | 1/1952 | Galliano et al. | 124/75 |
| 2,634,717 | 4/1951 | Junkin | 124/75 |
| 3,018,769 | 1/1962 | Parsoneault | 124/75 |
| 3,295,411 | 1/1967 | Lehmann | 89/1.810 |
| 3,838,676 | 10/1974 | Kahelin | 124/75 |
| 4,040,334 | 8/1977 | Smethers, Jr. | 89/1.804 |
| 4,263,835 | 8/1981 | Dragonuk | 89/1.51 |

*Primary Examiner*—David H. Brown

*Attorney, Agent, or Firm*—Harvey David; John Becker; Sol Sheinbein

[57] ABSTRACT

A pneumatic launcher for instrumented objects includes a barrel, a breech member having a compressed gas reservoir, a pneumatic piston operated valve for discharging gas from the reservoir into the barrel and is characterized by a fail-safe venting feature and a throttling valve for automatically limiting acceleration of the launched object.

5 Claims, 1 Drawing Sheet

PNEUMATIC LAUNCHER

BACKGROUND OF THE INVENTION

This invention relates to the field of pneumatic guns or launchers for expelling an object or device by the rapid expansion of air or other compressed gas, and more particularly to an improved launcher suitable to be carried by a ship or submarine for launching devices such as sonobouys or other instrument packages either above or below water.

Pneumatic guns and launchers of the type including a barrel, air storage means, and valve means for rapidly releasing the stored air into the barrel behind a projectile or object to be expelled have been known for some time. Those devices have had one or more shortcomings, when considered for use aboard a ship or submarine, including lack of provision for charging and firing control from a remote panel and lack of fail-safe provisions to prevent inadvertent discharge upon failure of piston seals or the like. In addition, the known devices have been of such construction that the initial acceleration of the projectile or package is greater than can be safely tolerated by sensitive instrumentation components and assemblies.

SUMMARY OF THE INVENTION

With the foregoing in mind, it is a principal object of this invention to provide an improved pneumatic launcher device suitable for use in launching objects or instruments, either above or below water, from a ship or submarine.

Another and important object of the invention is the provision of a pneumatic launcher having pneumatic remote control capability for charging and discharging of the launcher.

Yet another object is the provision of a pneumatic launcher device that is fail-safe in operation, whereby leakage of air past certain seals, valves or pistons will not result in inadvertent firing or discharge.

As still another object, the invention aims to provide an improved pneumatic launcher of the foregoing character and further having means for automatically limiting and regulating the pressure developed in the barrel behind the projectile so as to avoid excessive acceleration, or g-forces, and damage to sensitive instrumentation.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
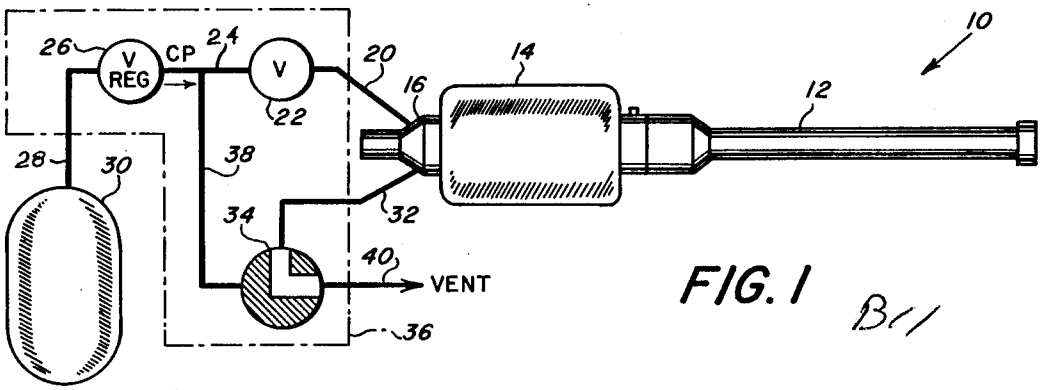
FIG. 1 is a side elevational view of a pneumatic launcher embodying the invention and shown diagrammatically in association with its air supply and remote firing control system.

In the form of the invention illustrated in the drawings and described hereinafter, and with reference first to FIG. 1, a launcher tube assembly 10 comprises a barrel 12 extending from a reservoir containing breech body 14. A piston housing 16 extends rearwardly from the breech body 14 and is connected via a pneumatic pipe or line 20, a valve 22, a line 24, and a supply pressure reducing valve 26 to a high pressure air supply line 28, shown connected to a flask 30 as a high pressure air source.

A firing or discharge control pipe or line 32 is connected from the housing 16 to a three-way firing control valve 34 conveniently mounted at a remote control station or panel 36. The valve 36 is further connected by line 38 to the regulated or reduced supply pressure line 24.

Briefly, the reservoir in the body 14 is charged with air at a predetermined pressure controlled by reducing valve 26. The 3-way firing control valve 34 is normally positioned so as to place line 32 in communication with a vent 40 at ambient pressure. As will presently be made apparent, the venting condition precludes inadvertent firing of the launcher in the event of piston seal leakage or failure, and firing is effected by positioning valve 34 to place line 32 in communication with regulated pressure line 38.

Figure 2:
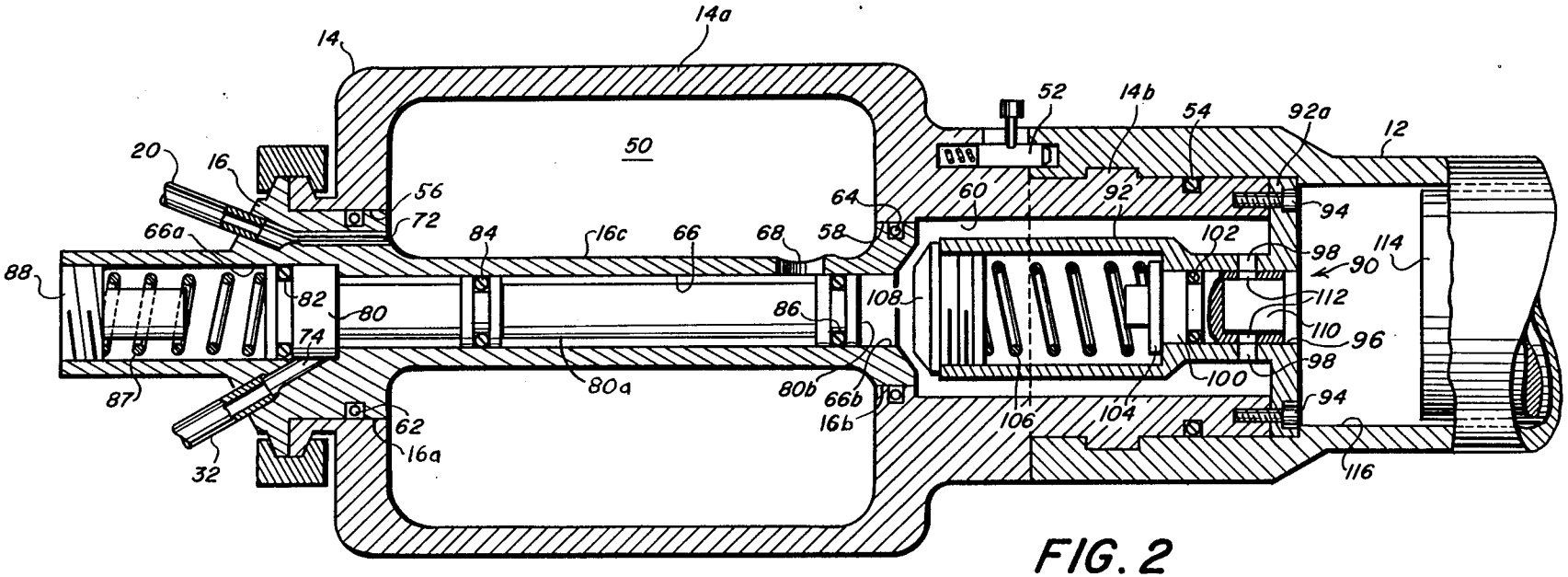
FIG. 2 is an enlarged longitudinal section view of the launcher of FIG. 1.

Referring now to FIG. 2, the breech body 14 has a generally cylindrical enlarged portion **14*a* defining an air reservoir 50, and a reduced portion 14*b* extending forwardly into the barrel 12, forward being to the right as viewed in the drawings. The breech body 14 and barrel 12 are conveniently separably connected as by cooperating interrupted threads, and locked against inadvertent rotation by a spring bolt 52. An O-ring 54 provides an air tight seal between the breech body 14 and the barrel 12**.

The body 14 is centrally bored to provide axially spaced and aligned bore segments 56 and 58 at the ends of the reservoir 50 and a cavity 60 in the forward body portion **14*b*. The piston housing 16 has enlarged diameter rear and front portions or bosses 16*a* and 16*b* received in the bores 56, 58 respectively and separated by a reduced, tubular guide portion 16*c*. O-rings 62 and 64 in the bosses 16*a* and 16*b* prevent leakage or pressurized air from the reservoir 50 past the body 16**.

The piston housing 16 has a stepped central bore 66 having a forward portion **66*b* opening into the cavity 60, and an enlarged diameter rear portion 66*a*. One or more ports 68 are formed in the guide portion 16*c* adjacent the forward end thereof and are adapted to communicate between the reservoir 50 and the bore portion 66*b*. An air inlet or charging passage 72 is formed in the piston housing 16 and connects the air pressure line 20 with the reservoir 50, while a firing and venting passage 74 connects line 32 with the enlarged portion 66*a* of bore 66**.

Reciprocably disposed in the enlarged portion **66*a* of bore 66 of housing 16 is a piston 80 carrying a sealing O-ring 82 and having a forwardly extending spindle or shaft portion 80*a* carrying an O-ring 84 and terminating in a valve portion 80*b* disposed in bore portion 66*b* and carrying an O-ring 86. The piston 80, including its spindle portion 80*a* and valve portion 80*b* is normally resiliently urged to its forward position illustrated in FIG. 2 by a spring 87 confined by a plug 88 in which position the valve portion 80*b* occludes the port or ports 68**.

Disposed in the cavity 60 of the body 14 is an automatic air flow limiting or throttling valve, generally indicated at 90 and comprising a generally hollow body 92 having a flange portion **92*a* fixed by screws 94 to the body 14 portion 14*b*. The flanged end of body 92 has a central bore 96 and a plurality of ports 98 communicating between the cavity 60 and the bore 96. Reciprocably disposed in bore 96 is a throttle valve member 100 carrying an O-ring 102. The aft end of member 100 has a flange 104 limiting forward movement under the influence of a spring 106 confined in body 92 by a plug 108. The forward end of the valve member 100 has an abbreviated bore or recess 110 and a plurality of ports 112 in registration with ports 98 when the valve member 100** is in its normal, illustrated position prior to firing.

An object or instrument package 114 to be projected or launched is loaded into the bore 116 of barrel 12 with its rear end adjacent the flange 92*a*. The instrument package typically is provided with seal means to minimize leakage of propelling air around it during firing.

MODE OF OPERATION

In preparation for "firing" or discharge of the apparatus to launch an object or instrument package loaded therein, the reservoir 50 is charged with air by operation of the valve 22 to a pressure determined by valve 26. At this time, the area around piston 80 between O-rings 82 and 84 is vented to ambient pressures via line 32 and valve 34.

When it is desired to effect a launch, the valve 34 is actuated to direct pressure, via line 32 to the space between the O-rings 82 and 84, causing the piston 80 to be moved to the rear against the action of spring 86. The valve portion 80*b* is thereby retracted rapidly to open ports 68 and allow pressurized air to flow through cavity 60, ports 98 and 112 into the barrel 12 behind the object to be launched. The pressure in the barrel rises rapidly and, if not throttled would cause correspondingly rapid increase in acceleration, possibly to g-force levels that would be damaging to sensitive components within the object being launched.

The rapid rise in pressure in the barrel 12 causes the throttle valve member 100 to be moved rearwardly against the action of spring 106, thereby moving the ports 112 out of full registry with the ports 98 and throttling the flow of air from the reservoir into the barrel at a reduced rate, thereby limiting the rise in pressure to a predetermined maximum, and hence the maximum acceleration to a predetermined amount, during the initial period of movement of the object. The object is thereby protected against g-force levels above a predetermined safe level for the instrumentation therein.

When the valve 34 is returned to its venting position, the piston 80 and valve portion 80*c* are automatically returned by spring 86 to their illustrated positions resealing the reservoir in readiness for subsequent charging, and the throttle valve member is returned by spring 106 to its ready position.

It will be noted that, because of the normally vented condition of passage 74, any leakage of air past O-ring 82 is vented and precluded from driving piston 80 to the rear and causing an inadvertent discharge of the device.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A pneumatic launcher comprising:

a source of pressurized gas;

a tubular barrel for receiving an object to be launched;

a breech body connected to said barrel and having an axial first bore opening into said barrel;

a reservoir chamber defined in said breech body for storing gas under pressure;

charging valve means for charging said reservoir chamber with gas from said source;

a piston housing extending through said reservoir chamber and having an axial, stepped second bore including an enlarged diameter portion and a smaller diameter portion, said smaller diameter portion opening into said first bore, said piston housing having first port means defined therein between said chamber and said smaller diameter portion of said second bore;

a piston disposed in said larger diameter portion of said second bore and a first valve member connected for movement with said piston and having a normal position occluding said first port means;

first spring means yieldably urging said piston to said normal position;

passage means in said piston housing communicating with said second bore on the side of said piston opposite said first spring means;

venting and discharge valve means, connected to and cooperable with said passage means and said source, for alternatively venting said passage means to ambient pressure or placing said passage means in communication with pressurized gas so as to move said piston and said first valve member from said normal position, whereby pressurized gas flows from said chamber through said first port means to effect increase in pressure in said barrel for expulsion of said object therefrom; and throttling valve means mounted in said axial first bore of said breech body and comprising a throttling valve body having an axial third bore and having second port means communicating between said first and said third bores, a throttling valve member disposed in said third bore and having third port means in registration with said second port means when said throttling valve member is in a fully open position, and second spring means yieldably urging said throttling valve member to said full open position, said throttling valve member being responsive to increases in pressure in said barrel to move away from said fully open position to a throttling position limiting flow of pressurized gas through said second and third port means to said barrel, whereby the pressure in said barrel is limited to a predetermined maximum.

2. A pneumatic launcher as defined in claim 1, and wherein:

said charging valve means comprises a pressure reducing valve and a cut-off valve connected in series between said source and said reservoir chamber.

3. A pneumatic launcher as defined in claim 2, and wherein:

said piston and said first valve member are sealed relative to said bore by first and second annular seals, respectively, and are connected by stem means sealed relative to said bore by a third annular seal disposed between said first and second annular seals; and said passage means communicates with said second bore between said first and third annular seals, whereby any leakage past said third seal will be vented and preclude inadvertent operation of said piston and launching of said object.

4. A pnuematic launcher as defined in claim 3, and wherein said charging valve means and said venting and discharge valve means are located at panel means remote from said barrel, breech member, and piston housing.

5. A pnuematic launcher as defined in claim 4, and wherein said venting and discharge valve means comprises a three-way valve.

* * * * *